US009691567B2

(12) United States Patent
Tortorici et al.

(10) Patent No.: US 9,691,567 B2
(45) Date of Patent: Jun. 27, 2017

(54) RECYCLABLE POLE OF AN ELECTRIC APPARATUS

(71) Applicant: Schneider Electric Industries SAS, Rueil Malmaison (FR)

(72) Inventors: Jean-Francois Tortorici, Saint Aunes (FR); Mehrdad Hassanzadeh, Clapiers (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/792,030

(22) Filed: Jul. 6, 2015

(65) Prior Publication Data

US 2016/0012985 A1 Jan. 14, 2016

(30) Foreign Application Priority Data

Jul. 11, 2014 (FR) ..... 14 56754

(51) Int. Cl.

| | |
|---|---|
| ***H01H 9/20*** | (2006.01) |
| ***H01H 33/66*** | (2006.01) |
| ***H01H 33/662*** | (2006.01) |
| ***H01H 9/02*** | (2006.01) |
| *H01H 9/00* | (2006.01) |

(52) U.S. Cl.

CPC ..... *H01H 9/20* (2013.01); *H01H 9/02* (2013.01); *H01H 33/6606* (2013.01); *H01H 33/66207* (2013.01); *H01H 2009/0077* (2013.01); *H01H 2033/6623* (2013.01)

(58) Field of Classification Search

CPC ..... H01H 9/20; H01H 9/00

USPC ..... 200/293, 17 R, 48 R

See application file for complete search history.

(56) References Cited

U.S. PATENT DOCUMENTS 5,808,258 A * 9/1998 Luzzi ..... H01H 33/66207 218/136
2007/0241080 A1 10/2007 Stoving et al.
2008/0217148 A1 9/2008 Kowalyshen et al.
(Continued)

FOREIGN PATENT DOCUMENTS

FR 2 979 476 A1 3/2013
JP 2006-092781 4/2006
(Continued)

OTHER PUBLICATIONS

French Preliminary Search Report issued Mar. 13, 2015 in French Application 14 56754, filed on Jul. 11, 2014 (with English Translation of Categories of Cited Documents).

*Primary Examiner* — Edwin A. Leon
*Assistant Examiner* — Iman Malakooti
(74) *Attorney, Agent, or Firm* — Oblon, McClelland, Maier & Neustadt, L.L.P.

(57) ABSTRACT

An electrical equipment includes easily separable components, where, in particular, the electrical connections are immobilized by screws in a body, and can be extracted by a simple translational movement when the screws have been removed. The active part can also easily extractable. When combined with the fabrication of an outer body made of thermoplastic material, these features, allowing for easy disassembly, make it possible to easily recycle the equipment, which may be a circuit breaker, a switch, etc.

10 Claims, 2 Drawing Sheets

(56) References Cited

U.S. PATENT DOCUMENTS

| | | | | |
|---|---|---|---|---|
| 2010/0072045 | A1* | 3/2010 | Freundt ..... | H01H 33/666<br>200/293 |
| 2011/0227252 | A1 | 9/2011 | Kowalyshen et al. | |
| 2012/0311851 | A1 | 12/2012 | Kowalyshen et al. | |
| 2013/0212873 | A1 | 8/2013 | Kowalyshen et al. | |

FOREIGN PATENT DOCUMENTS

| | | |
|---|---|---|
| JP | 2008-171654 | 7/2008 |
| WO | WO 00/41199 | 7/2000 |
| WO | WO 2008/100511 A1 | 8/2008 |
| WO | WO 2011/095980 A1 | 8/2011 |
| WO | WO 2012/006172 A1 | 1/2012 |

* cited by examiner

RECYCLABLE POLE OF AN ELECTRIC APPARATUS

FIELD OF THE INVENTION

The present invention relates to a recyclable electrical switchgear pole.

DESCRIPTION OF RELATED ART

The electrical poles discussed here, which are used notably at low, medium or high voltage, comprise an active part, electrical connections connected to the active part, and an outer body wherein the active part and the electrical connections are retained, the connections leading to the outside of the body.

In most cases, the body is made of a thermosetting material such as epoxy, polyurethane, vinyl ester or unsaturated polyester, or even an elastomer such as polyester, EPDM or silicone. These materials are not recyclable as their transformation into a solid state is irreversible. The growing demands to make industrial products recyclable has led to the search for new designs for these electrical poles. For this reason we have proposed to construct the outer body using thermoplastic materials (e.g., in document WO 2011/0095980 or WO 2012/006172), which, as they consist of a reversible network, are able to soften or melt when heated, allowing them to be reused.

However, even these improved designs are not enough to allow for easy recycling since the various components of the poles, made of various materials, must still be separated and thus ensure that impurities do not remain in the recycled product during the customary grinding operation prior to remelting and recycling. As good mechanical behaviour of the poles in service is sought, the assembly of the various components is undertaken with great cohesion, and the active part and the connections are in practice inseparably embedded in the outer body, which is overmoulded on them. The connecting means consist of strong adhesion of the body on certain surfaces, such as ceramic vacuum interrupters for example, or encapsulation of complex shaped parts in the body, i.e. imprisonment of these parts in the body, by way of shape cohesion, with or without adhesion of their material.

SUMMARY OF THE INVENTION

The invention seeks to obviate these recycling difficulties by providing an electrical switchgear pole whose components are easy to separate in an impeccable manner, i.e. without leaving impurities in adjoining parts.

In a general form, the invention relates to an electrical switchgear pole, comprising an outer body, an active part retained in a housing of the body, and connections passing through openings in a wall of the body and leading to outside the body and in the housing, characterised in that the connections consist of portions having constant cross-sections or tapering towards the housing, and are secured in the openings by detachable blocking means.

The electrical connections can thus be extracted by simple, translational movements, once the blocking means have been removed. No destruction by machining, cutting or grinding is required, for example, in order to separate the components, since the various materials separate perfectly without leaving impurities in the components (body, active parts, metal connections) to be recycled or, more generally, to be reused once they have been separated. The blocking means are extracted by simple disassembly operations that do not involve damaging the body.

The body is advantageously made of a thermoplastic material so that it can be recycled in the event of damage, unlike conventional designs where the components of the pole cannot be removed in any case.

The blocking means may advantageously be screws engaged in the connections, and the drill holes are perpendicular or oblique to the connections. The screws are an example of perfectly removable blocking means. In one particular design, a screw can also be used to secure the active part, and its rod passes through one of the electrical connections to stop it. This design is particularly simple.

Some of the blocking means may occupy the holes passing through the wall of the body, and thus retain the corresponding connections, blocking them relative to the body. The blocking means are thus normally accessible from outside the body for disassembly. They can also be used to retain the active part, by immobilizing it in the housing. The blocking means may also be internal to the body and arranged in the housing, and be removable through an opening in the latter. These various possibilities are compatible with a good cohesion of the active part and connections with the body, using only a small number of blocking means.

Another improvement, allowing both simple manufacture of the body having good cohesion with the connections, without compromising subsequent ease of extraction of the connections, appears if the body is moulded onto the connections.

Another aspect of the invention relates to the ease of disassembly of the active part. The housing body may thus advantageously comprise an opening for the active part, with a regular cross section or which widens towards the opening, thereby allowing the active part to be extracted from the body simply by pulling it, once the blocking means have been removed. The sliding of the active part out of the housing will be facilitated if it is provided with sliding collars, for example, projecting on its periphery, which make it adhere to the housing by a small surface area.

According to certain other improvements, the connections include a cylindrical outer portion, preferably of revolution, and an inner portion having a hole wherein at least one of the blocking means is engaged, respectively, the inner portion having a smaller section than the outer portion for each of the connections. The outer portion of regular shape allows easy connections to other equipment and avoids the electric field irregularities, and the inner portion allocated to connections with other components of the switchgear, can have an irregular shape, notably for imbrication with the surrounding material of the outer body, which promotes cohesion of the pole by hindering the pivoting movements of the connections, but allowing only those in the direction of extraction or insertion, i.e. in the axial direction from the openings.

In particular, the inner portions may include grooves extending in an axial direction of the openings, the grooves being filled by the material of the body. The material of the body can easily fill these grooves if, for example, the body is overmoulded onto the connections: the imbrications obtained are rigid with respect to pivotal movements of the connections, without hindering the extraction of the connections when the pole is removed. One of the connections may also have its inner portion in the shape of a tab.

BRIEF DESCRIPTION OF THE DRAWINGS

The invention is described more fully in its various aspects, features and advantages in connection with the following Figures, which illustrate a non-exclusive embodiment.

DETAILED DESCRIPTION OF THE PREFERRED EMBODIMENT

Figure 1:
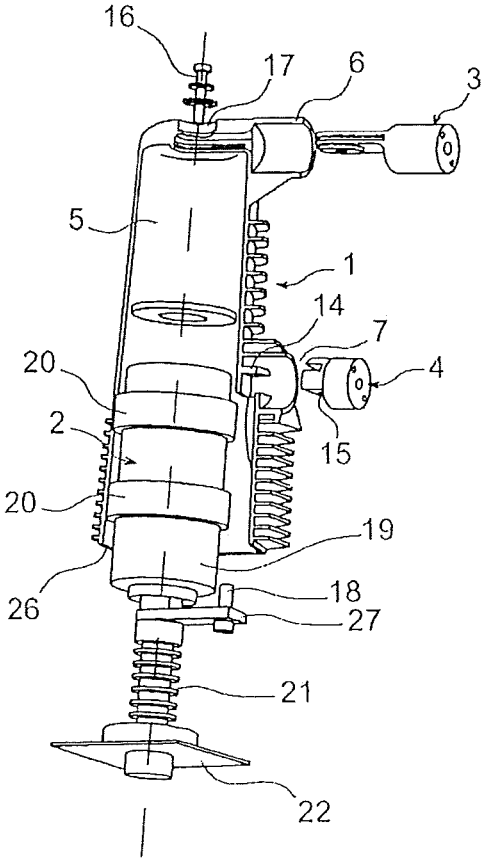
FIG. 1 is a general cross-sectional view of the pole.

FIG. 1 represents an exploded view of an electrical switchgear pole according to the invention. An outer body 1 houses an active part 2, here belonging to a vacuum bottle, an upper electrical connection 3 and a lower electrical connection 4 connected to the active part 2 and leading to the exterior. The body 1 (FIG. 2) is generally cylindrical in shape (square, round or preferably polygonal cross-section), with a central housing 5 opening downwardly to receive the active part 2, an upper side opening 6 to contain the upper connection 3, and even a lower opening 7 to contain the lower connection 4. The housing 5 is also cylindrical, preferably of revolution even if the cross-section may be any other shape.

Figure 3:
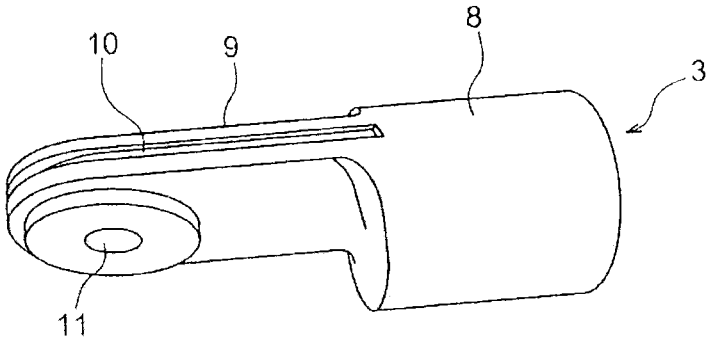
FIGS. 3 and 4 illustrate the separate electrical connections.
Figure 4:
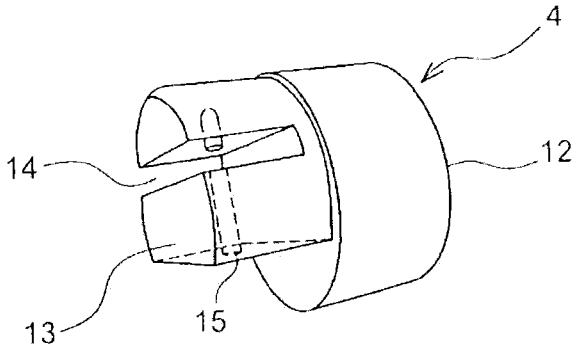

The upper connection 3 comprises (FIG. 3) an outer cylindrical portion 8, preferably of revolution, and an inner portion 9, in the shape of a flat tab and whose thickness face features a groove 10; the inner portion 9 preferably has the same or smaller cross-section than the outer portion 8 so to further facilitate the extraction. The end of the tab features a fixing hole 11.

The lower connection 4 also comprises an outer cylindrical portion 12, advantageously of revolution, and an inner portion 9, in the shape of a flat tab and whose thickness face features a groove 10; the inner portion 9 preferably has the same or smaller cross-section than the outer portion 8 so to further facilitate the extraction. The end of the tab features a fixing hole 11 and an inner portion 13 of smaller cross-section, and which is provided with a longitudinal groove 14 and a threaded hole 15 in the radial direction. The inner portion 13 preferably has the same or smaller cross-section than the outer portion 12 so to further facilitate the extraction. The switchgear further comprises an upper screw 16 for fixing the upper connection 3 and the active part 2, the head of which is created in a seat 17 recessed at the top of the body 1 and the rod of which passes through the upper part of the body 1, the fixing hole 11, and is screwed into an internal thread created at the top of the active part 2. When the upper screw 16 is in place, it thus prevents the active part 2 from falling to the bottom of the housing 5 and to exit the body 1, and it also prevents the upper connection 3 from being extracted out of the upper opening 6. A lower screw 18 is engaged in the threaded hole 15. The screws 16 and 18 are advantageously perpendicular to the openings 6 and 7, and therefore to the connections 3 and 4, without it being necessary.

The active part 2 includes a cylindrical housing 19, provided with two collars 20 in the form of projecting strips, which are in sliding abutment on the inner face of the body 1. The active part 2 shown here is a vacuum bottle. An internal control mechanism 21, housed at the bottom of the body 1, can be seen which will be actuated by a separate element, not shown, outside the pole. A lower cover 22 is screwed to the bottom of the body 1 of an opening 26 of the housing to close the housing 5; alternatively, a membrane may be used to close the housing. Another element of the active part 2 is a movable contact 27. The lower screw 18 passes through a hole in the movable contact 27 and thus connects it to the lower connection 4. It is internal to the housing 5, but accessible from the outside its head, through which it can be removed, being directed towards the opening 26, and situated in a widening 28 of the housing 5, which allows a tool to be inserted through the opening 26.

The features of the invention relate mainly to the possibility of easily separating its components for recycling purposes. This can be done easily by removing the screws 16 and 18. The connections 3 and 4, being composed of portions whose cross-section is constant or tapering towards the interior of the openings 6 and 7 can then be extracted, without effort or with minimal effort, from the body 1, and the active part 2 can be easily extracted through the opening 26 once the lower cover 22 has been removed, by pulling it downward, thanks to the reduced friction that it exerts against the body 1 by the collars 20 of small size. There is no danger of tearing or destruction of material, which guarantees perfect separation of the various materials once the components have been dismantled. This design is compatible with good dielectric strength, as significant relief is avoided, since the electrical connections 3 and 4 and the screw 16 are contained in the openings and the bores of the body 1 are nearly flush with its surface. The screw 18 is inside the body 1. Good mechanical cohesion is guaranteed despite the ease with which the various elements are separated, since the active part 2 remains firmly held in the body 1 and that the interlocking (clearly shown in FIG. 2) of the material of the body 1 in the grooves 10 and 14 prohibits the majority of movements of the connections 3 and 4 and in particular the pivoting, only movements in the direction of extraction are possible, and it is only these that are stopped by the screws 16 and 18. The cohesion of the electric pole is thus nearly as good as good those of existing switchgear, despite the absence of embedding, encapsulation or strong adhesion between the different parts.

Figure 2:
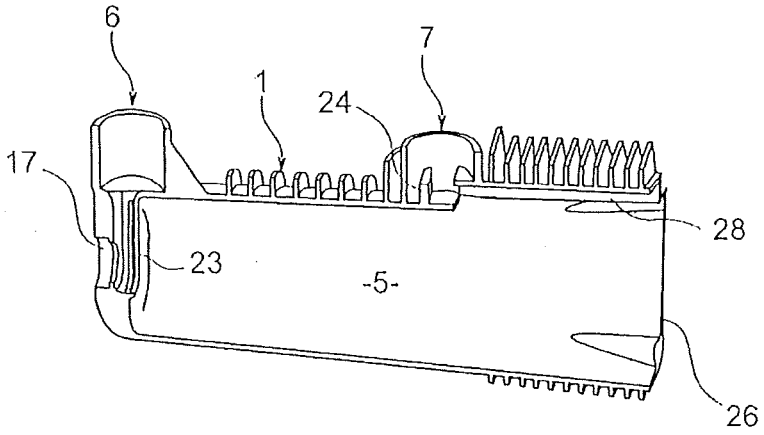
FIG. 2 is a cross-sectional view of the separate outer body.

The manufacture can be accomplished by overmoulding the body 1 onto the connections 3 and 4: the thermoplastic material of the body 1 thus enters the grooves 10 and 14, forming tabs 23 and 24, shown in FIG. 2. Alternatively, it would be possible to construct the body 1 by a separate moulding operation, then assembling the electrical connections 3 and 4. The active part 2 is then installed and the screws 16 and 18 tightened.

The electrical switchgear may notably be low, medium or high voltage switchgear, such as a circuit breaker, a switch, a recloser, contactor, disconnector, or other element. Certain thermoplastic materials that are suitable for constructing the body 1 are polyethylene, high density polyethylene, polyethylene terephthalate, polypropylene, polystyrene, aliphatic or semi-aromatic polyamide, polyphthalamide, polyarilamide, or any other injectable thermoplastics or TPE (thermoplastic elastomers).

Many other embodiments are of course possible. In this manner, numerous types of blocking means are possible. Several screws 16 or 18 may be provided to retain the connections 3 and 4 and the active part 2 with greater force. The blocking means, such as screws 16 and 18 can pass through the wall of the body 1 perpendicularly or obliquely, or, if they are internal such as the screw 18, they may be oblique or perpendicular to the connections 3 and 4. There is obviously a large choice of cross-sectional shapes for the inner portions 9 and 13, in order to prevent the connections 3 and 4 from pivoting, such as flats, dovetails, etc., and in general all cross-sections of irregular shape.

Once the active part 2 and the connections 3 and 4 have been removed from the body 1, the hence unusable components can then be recycled directly, and the others reused without precautions, since they were not damaged during removal, and notably no part of the constituents were torn and remain on a neighbouring component, which could require extra sorting work. The guarantee of not damaging the still usable components and therefore being able to reuse them is an important advantage of the invention.

The invention claimed is:

1. An electrical switchgear pole, comprising:

an outer body, an active part retained in a housing of the body, and connections passing through first and second openings in a wall of the body and extending outside the body and inside the housing, wherein the connections include portions having constant cross-sections or tapering towards the housing, and are secured in the first and second openings by at least one detachable blocking device that is perpendicular or oblique to the first and second openings, and wherein the body has at least one third opening formed therein, said at least one third opening being separate from said first and second openings, and the at least one detachable blocking device is accessible through the at least one third opening.

2. The electrical switchgear pole according to claim 1, wherein the body is made of recyclable material.

3. The electrical switchgear pole according to claim 1, wherein the at least one blocking device includes screws.

4. The electrical switchgear pole according to claim 1, wherein at least one part of the at least one blocking device occupies one of the at least one third opening.

5. The electrical switchgear pole according to claim 1, wherein the body is overmoulded on the connections.

6. The electrical switchgear pole according to claim 1, wherein the housing of the body comprises an opening for the active part and has a regular cross-section or widening toward the opening.

7. The electrical switchgear pole according to claim 6, wherein the active part is equipped with sliding collars in the housing.

8. The electrical switchgear pole according to claim 1, wherein the at least one blocking device secures the connections to the active part.

9. The electrical switchgear pole according to claim 1, wherein the connections comprise cylindrical outer portions, and inner portions with irregular cross-section, having imbrications in the first and second openings.

10. An electrical switchgear pole, comprising:

an outer body, an active part retained in a housing of the body, and connections passing through openings in a wall of the body and extending outside the body and inside the housing, wherein the connections include portions having constant cross-sections or tapering towards the housing, and are secured in the openings by at least one detachable blocking device, wherein the connections comprise cylindrical outer portions and inner portions with irregular cross-section, having imbrications in the openings, and wherein the inner portions comprise grooves extending in an axial direction from the openings, the grooves being filled by the material of the body.

* * * * *